United States Patent [19]

Raffa

[11] 3,989,255

[45] Nov. 2, 1976

[54] PUZZLE EMPLOYING MOVABLE MEMBER IN TUBULAR MAZE

[75] Inventor: Jerry Raffa, Healdsburg, Calif.

[73] Assignee: The Raymond Lee Organization, Inc., a part interest

[22] Filed: Oct. 21, 1975

[21] Appl. No.: 624,540

[52] U.S. Cl. ..... 273/153 R; 273/109

[51] Int. Cl.[2] ..... A63F 9/08

[58] Field of Search ..... 273/109, 153 R; 46/43

[56] References Cited

UNITED STATES PATENTS

| | | | |
|---|---|---|---|
| 839,733 | 12/1906 | Davenport | 273/109 UX |
| 3,069,805 | 12/1962 | Burrows | 273/153 R UX |
| 3,610,624 | 10/1971 | Fleischer | 46/43 |
| 3,758,981 | 9/1973 | Hlasnicek | 273/109 UX |

*Primary Examiner*—Anton O. Oechsle

[57] ABSTRACT

A bean-like member is placed into one end of a maze of hollow, flexible, transparent tubing with an inside diameter greater than the maximum width of the bean. The object of the puzzle is to cause the bean to drop into the interior of a cup with a detachable cap. The cup is secured to the tubing. The bean is caused to traverse the tubing by shaking and rotating the unit.

6 Claims, 3 Drawing Figures

PUZZLE EMPLOYING MOVABLE MEMBER IN TUBULAR MAZE

SUMMARY OF THE INVENTION

The object of the invention is to provide a new type of manually operable puzzle. In this device, a maze is formed by a twisted mass of hollow, transparent tubes into which a brightly colored bean is introduced. A first section of tubing communicates with the interior of a hollow cup. A plurality of second sections of tubing communicate with each other and with the first section, but not directly into the cup. The inner diameter of the tubing is larger than the largest outer diameter of the bean whereby the bean will slide along the tubing. Thus, the puzzle must be shaken and rotated to cause the bean to travel to the cup without getting trapped or detoured in one of the second sections of tubing. Since the tubing is transparent, the movement of the bean in the tubing is visible. The bean can always be located, thus providing the operator of the puzzle with a visual means of correcting the path through which the bean passes.

DETAILED DESCRIPTION OF PREFERRED EMBODIMENTS

Figure 1:
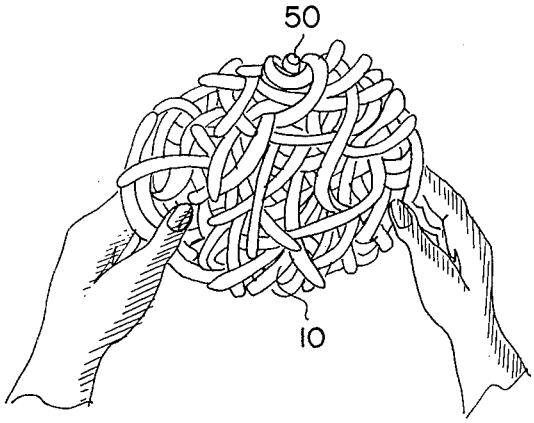
FIG. 1 shows the invention in use.
Figure 3:
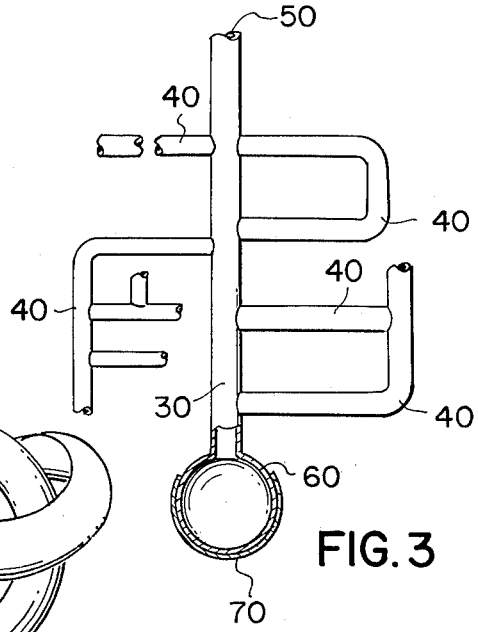
FIG. 3 is a cross-sectional view of another portion of the invention.
Figure 2:
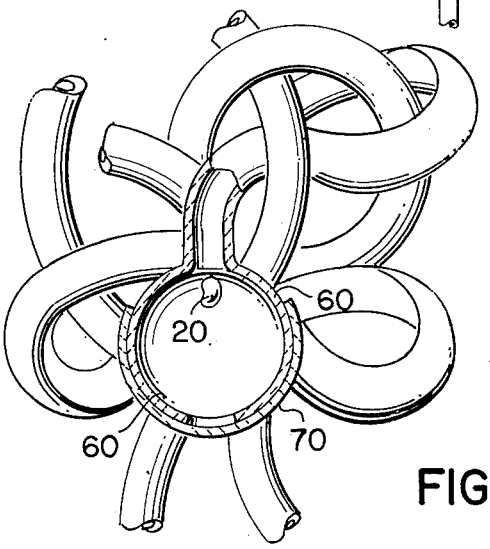
FIG. 2 is a cross-sectional view of a portion of the invention.

As is shown in FIG. 1, the puzzle generally takes the form of an oblate spheroid. The puzzle is formed from hollow, flexible and transparent plastic tubing 10. The tubing has smooth inner walls. The inside diameter of the tubing is larger than the maximum width of a bean 20 that is introduced into the tubing and that is brightly colored, as for example being colored red, for visibility. The bean can, of course, be replaced by a suitable imitation of plastic or the like. The outer surface of the bean must be smooth.

The tubing has a first section 30 and a plurality of second sections 40. The first section has an open end

50 into which the bean is originally introduced, and communicates with the interior of a hollow cup 60 that has a detachable cap 70. The second sections 40 communicate with each other and with the first section, but do not communicate with the cap. They thus serve as traps and detours which are to be avoided while rotating the device, to eventually cause the bean to drop into the cup. The cap may then be removed from the cup, enabling the bean to be removed and re-introduced into the open end. The puzzle can also be operated in reverse fashion by trying to guide the bean out of the cup and back out of section 5*a*. This is much more difficult.

Although the invention has been described with particular reference to the drawings, the protection sought is to be limited only by the terms of the claims which follow.

What is claimed is:

1. A puzzle, comprising:

a bean-like member having a smooth outer surface;

a hollow cup;

a first section of hollow tubing with an inside diameter greater than the maximum width of the bean, one end of the first section communicating with the interior of the cup; and a plurality of second sections of tubing of like inside diameter, said second sections communicating with each other and with the first section, said second sections being isolated from the cup, said first section and said second sections being formed into a twisted mass of tubing through which said bean-like member is slidable in an effort to cause said member to enter said cup.

2. The puzzle of claim 1 wherein the cup has a detachable cap.

3. The puzzle of claim 2 wherein the tubing is flexible.

4. The puzzle of claim 3 wherein the tubing is transparent.

5. The puzzle of claim 4 wherein the member is brightly colored.

6. The puzzle of claim 5 wherein all of said sections have smooth inner walls.

* * * * *